US005890039A

United States Patent [19]

Yoo

[11] Patent Number: 5,890,039

[45] Date of Patent: Mar. 30, 1999

[54] APPARATUS FOR PREVENTING TONER FROM SETTLING IN A WET DEVELOPING UNIT

[75] Inventor: Yong-baek Yoo, Kyungki-do, Rep. of Korea

[73] Assignee: Samsung Electronics Co., Ltd., Kyungki-Do, Rep. of Korea

[21] Appl. No.: 96,353

[22] Filed: Jun. 12, 1998

[30] Foreign Application Priority Data

Jul. 16, 1997 [KR] Rep. of Korea ..... 97-18827

[51] Int. Cl.[6] ..... G03G 15/10

[52] U.S. Cl. ..... 399/238

[58] Field of Search ..... 399/233, 237, 399/246, 247, 238; 347/85, 89

[56] References Cited

U.S. PATENT DOCUMENTS

| | | | |
|---|---|---|---|
| 4,234,885 | 11/1980 | Arway | 347/85 |
| 4,398,818 | 8/1983 | Jeromin et al. | 399/247 |
| 4,827,309 | 5/1989 | Kato | 399/247 |
| 5,585,900 | 12/1996 | Lior et al. | 399/233 |
| 5,623,715 | 4/1997 | Clark | 399/238 X |
| 5,713,062 | 1/1998 | Goodman et al. | 399/238 X |
| 5,722,017 | 2/1998 | Caruthers, Jr. et al. | 399/238 |

*Primary Examiner*—S. Lee

*Attorney, Agent, or Firm*—Sughrue, Mion, Zinn, Macpeak & Seas, PLLC

[57] ABSTRACT

An apparatus for preventing toner from settling in a wet developing unit, includes (1) a storage vessel for storing a developer, (2) a developing portion for developing electrostatic latent images formed on a photosensitive medium, (3) a flow pipe having-one end connected to the storage vessel, (4) a cabinet connected to the other end of the flow pipe, for receiving the developer from the storage vessel, (5) a circulation pipe connected to the cabinet and the storage vessel, for returning the developer from the cabinet to the storage vessel, (6) a supply pipe connected to the cabinet and the developing portion, for supplying the developer from the cabinet to the developing portion, and (7) a flow path changing unit for selectively directing the developer supplied via the flow pipe to either the supply pipe or the circulation pipe.

9 Claims, 5 Drawing Sheets

APPARATUS FOR PREVENTING TONER FROM SETTLING IN A WET DEVELOPING UNIT

BACKGROUND OF THE INVENTION

1. Field of the Invention

The present invention relates to a developing unit in a wet electrophotographic printer, and more particularly, to an apparatus for preventing toner from settling in a developer storage vessel.

2. Description of the Related Art

A developing unit in a wet electrophotographic printer, as shown in FIG. 1, includes a storage vessel 11 for storing a developer I, and a developing portion 12 for developing electrostatic latent images formed on a photosensitive means such as a photosensitive belt 14. The developer I used in such electrophotographic printers is a mixture comprising a powder toner of a predetermined color and a liquid carrier.

During a print operation, a pump 15 causes the developer I in the storage vessel 11 to flow through a developer supplier 13. Accordingly, the developer I is supplied to the developing portion 12, where it is applied to the photosensitive belt 14 using a developing roller 121. The developer I which does not adsorb onto the photosensitive belt 14 returns to the storage vessel 11 via a recovery tube 16.

If the developer I in the storage vessel 11 becomes stagnant, the powder toner separates from the liquid carrier and settles onto the floor of the storage vessel 11. Such a stagnant condition exists, for example, when printing is not performed for an extended period of time. Conventionally, therefore, the developing unit includes an apparatus for mixing the developer within the storage vessel 11, thereby avoiding a stagnated condition. Specifically, a first magnet 18*a* is rotatably installed under the storage vessel 11. A driving motor 17 imparts rotational movement to the first magnet 18*a*. A second magnet 18*b* is installed on the bottom of the storage vessel 11. The second magnet 18*b* rotates, due to magnetic affects, along with the rotational movements of the first magnet 18*a*. A blade 19 coupled to the second magnet 18*b* stirs the developer I in the storage vessel 11 to prevent the toner from separating from the liquid carrier.

A toner intake 111 and a carrier intake 112 are installed in the storage vessel 11 to provide the developer I with a constant mixture ratio.

Although generally thought to be acceptable, conventional apparatus are not without shortcomings. In particular, since the second magnet 18*b* must be rotatably installed inside the storage vessel 11, assembly of the apparatus is difficult. Also, it is difficult to repair and/or replace the second magnet 18*b*.

SUMMARY OF THE INVENTION

An object of the present invention is to improve the developer circulation structure of a developing unit, by not employing a magnet to stir the developer. Accordingly, an apparatus for preventing settling of toner for a wet developing unit, comprises: a storage vessel for storing a developer; a developing portion for receiving the developer and developing electrostatic latent images formed on a photosensitive medium; a flow pipe having one end connected to the storage vessel; a cabinet connected to another end of the flow pipe, for receiving the developer from the storage vessel; a circulation pipe connected to the cabinet and the storage vessel, for leading the developer within the cabinet to the storage vessel; a supply pipe connected to the cabinet and the developing portion, for supplying the developer within the cabinet to the developing portion; and a flow path changing unit for directing the developer supplied to the cabinet via the flow pipe to either the supply pipe or the circulation pipe.

In a first embodiment, the flow pipe branches into a first branch pipe and a second branch pipe. Both branch pipes are connected to the cabinet. The flow path changing unit comprises: a valve member rotatably installed inside the cabinet, and provided with a through hole for selectively leading the first branch pipe to the supply pipe or the second branch pipe to the circulation pipe; and a driving source for rotating the valve member at a predetermined angle.

In a second embodiment, a flow space formed in the cabinet receives developer entering the cabinet via the flow pipe. The flow path changing unit comprises: a valve member rotatably installed inside the cabinet, and provided with a through hole for selectively leading the developer in the flow space to either the supply pipe or the circulation pipe; and a driving source for rotating the valve member at a predetermined angle.

The above and other features of the invention including various and novel details of construction and combination of parts will now be more particularly described with reference to the accompanying drawings and pointed out in the claims. It will be understood that the particular wet developing unit embodying the invention is shown by way of illustration only and not as a limitation of the invention. The principles and features of this invention may be employed in varied and numerous embodiments without departing from the scope of the invention.

DESCRIPTION OF THE PREFERRED EMBODIMENTS

Figure 1:
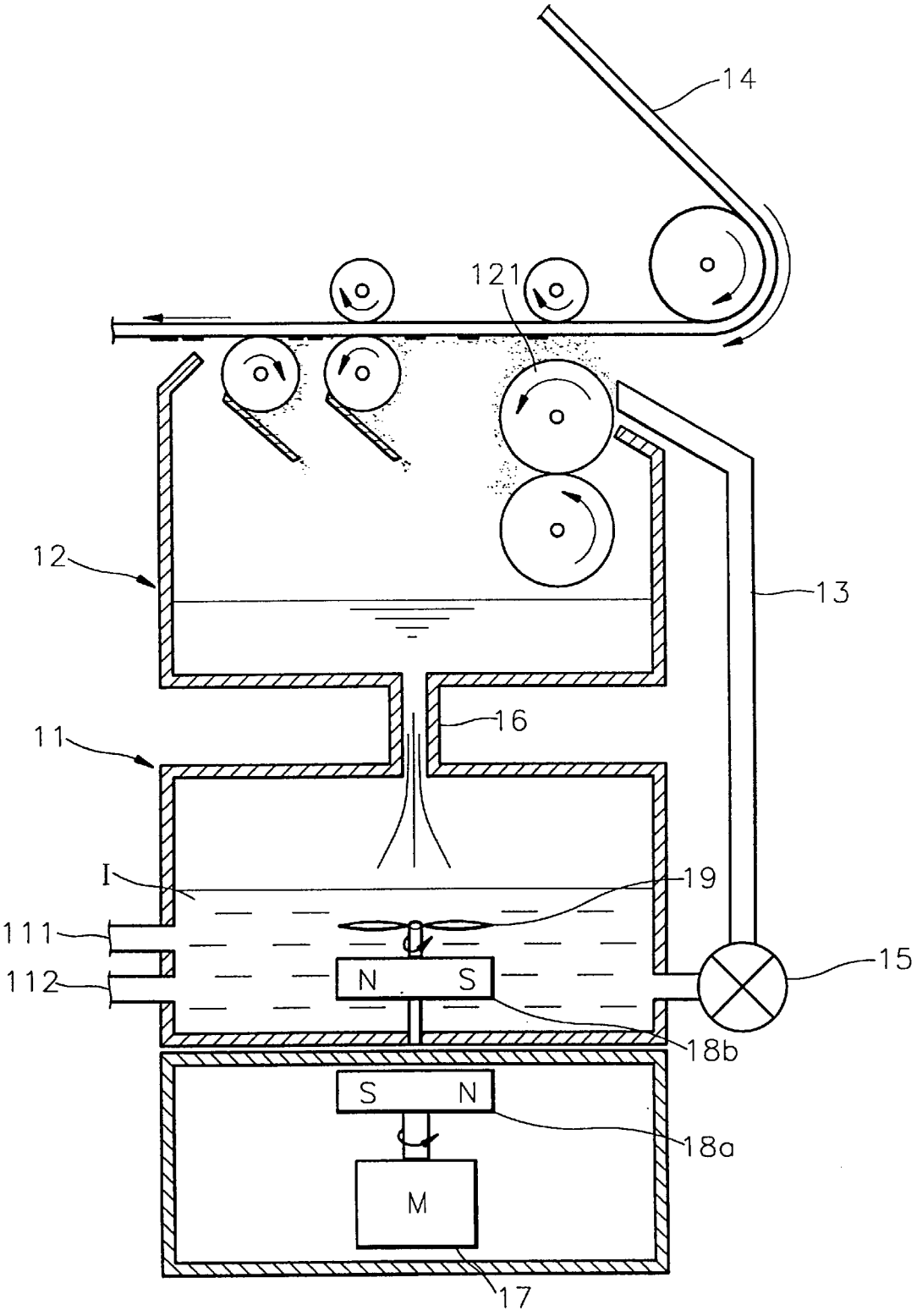
FIG. 1 (PRIOR ART)
FIG. 1 is a schematic illustration of a wet developing unit adopting a conventional apparatus for preventing settling of toner.
Figure 2:
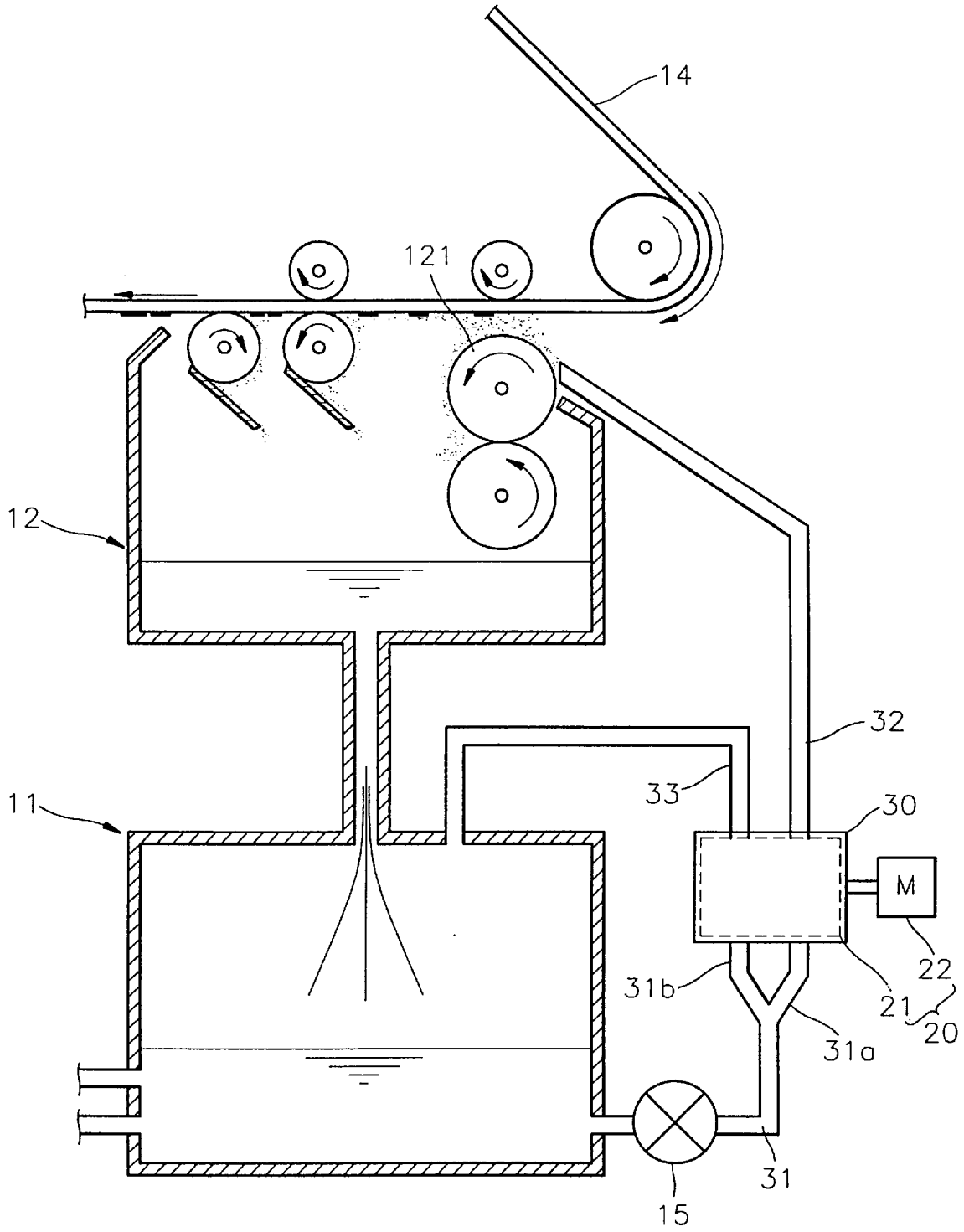
FIG. 2 is a schematic illustration of a wet developing unit adopting an apparatus for preventing settling of toner according to the present invention.

In FIG. 2, component parts which are the same as those illustrated in FIG. 1 are designated by the same reference numerals.

Referring to FIG. 2, in an apparatus for preventing settling of toner according to an embodiment of the present invention, a developer stored in a storage vessel 11 is circulated by a pump 15 while printing is not performed.

A cabinet 30 is installed on a developer flow path connecting the storage vessel 11 to a developing portion 12. The storage vessel 11 and the cabinet 30 are connected to each other by a flow pipe 31. One end of the flow pipe 31 communicates with the storage vessel 11, and the other end thereof is branched into a first branch pipe 31*a* and a second branch pipe 31*b*. Both branch pipes 31*a*, 31*b* communicate with the cabinet 30.

A supply pipe 32 and a circulation pipe 33, respectively corresponding to the first and the second branch pipes 31*a* and 31*b,* are connected to the cabinet 30. The supply pipe 32 supplies the developer to a developing roller 121 of the developing portion 12. The circulation pipe 33 is connected to the storage vessel 11, and returns the developer from the cabinet 30 to the storage vessel 11.

Figure 3:
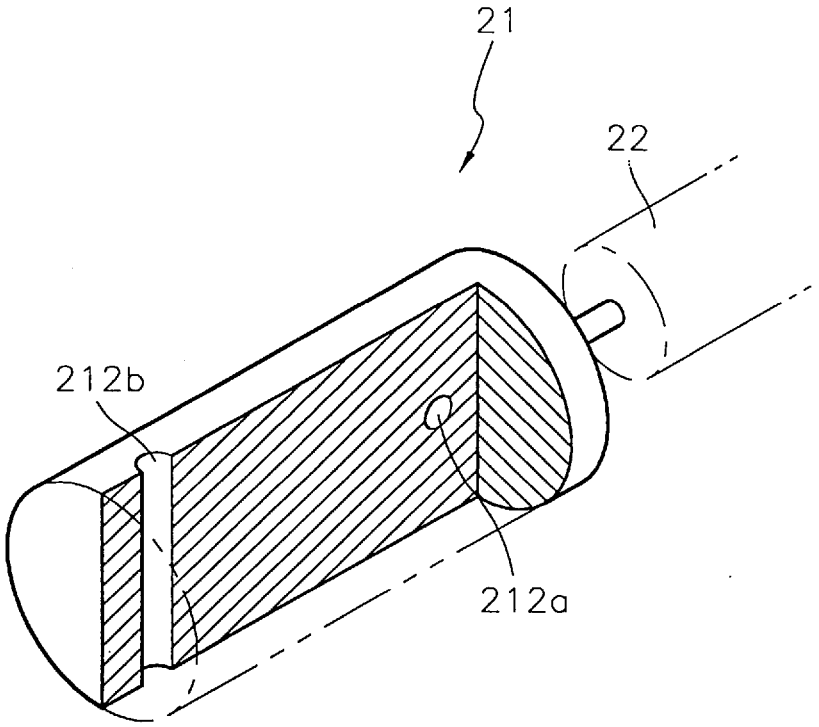
FIG. 3 is a perspective view of the valve member and the driving source of FIG. 2.
Figure 4:
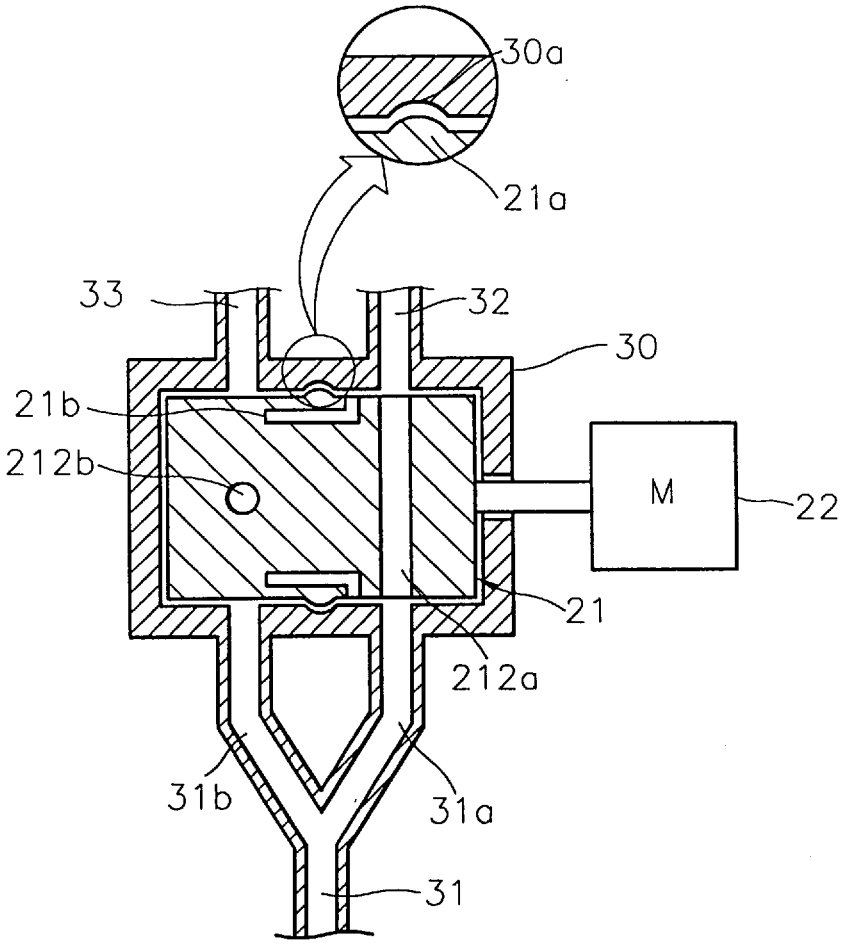
FIGS. 4 and 5 are partial cross-sectional views of the apparatus for preventing settling of toner of FIG. 2.

Referring to FIGS. 2 through 4, a flow path changing unit 20, for selectively feeding the developer supplied from the flow pipe 31 into the supply pipe 32 or the circulation pipe 33, is installed inside the cabinet 30. That is, the flow path changing unit 20 connects the first branch pipe 31*a* to the supply pipe 32 or connects the second branch pipe 31*b* to the circulation pipe 33.

The flow path changing unit 20 includes a valve member 21 rotatably installed inside the cabinet 30. Through holes 212*a* and 212*b* are provided in the valve member 21 for leading either the first branch pipe 31*a* to the supply pipe 32 or the second branch pipe 32*a* to the circulation pipe 33. The flow path changing unit 20 also includes a driving motor 22 for rotating the valve member 21 at a predetermined angle.

The through holes 212*a* and 212*b* are formed in different directions, for example, in FIG. 4, they form an angle of about 90°. A flow path linking the first branch pipe 31*a,* the through hole 212*a* and the supply pipe 32 or a flow path linking the second branch pipe 31*b,* the through hole 212*b* and the circulation pipe 33 is selectively formed by the rotational position of the valve member 21. Thus, if the flow path through the first branch pipe 31*a,* through hole 212*a* and supply pipe 32 is formed, the developer is supplied to the developing portion 12. On the other hand, if the flow path through the second branch pipe 31*b,* through hole 212*b* and circulation pipe 33 is formed, the developer flows back to the storage vessel 11.

It is preferable that the valve member 21 is appropriately rotated and then locked by a locking means. As shown in FIG. 4, the locking means includes a locking groove 30*a* formed inside the cabinet 30. Moreover, a locking protrusion 21*a* formed on the exterior surface of the valve member 21 is insertable into the locking groove 30*a.* An elastic space 21*b* provided under the locking protrusion 21*a,* allows the locking protrusion 21*a* to elastically deflect away from the locking groove 30*a,* when the valve member is rotated.

The present invention operates as follows. In a printing operation, the first branch pipe 31*a* leads to the supply pipe 32 via the first through hole 212*a,* and the passage between the second branch pipe 31*b* and the circulation pipe 33 is blocked by the valve member 21, as shown in FIG. 4. Thus, the pump 15 circulates the developer from the storage vessel 11, through the cabinet 30 and the supply pipe 32. Thus, the developer is supplied to the developing roller 121 of the developing portion 12, where it may adhere to the photosensitive belt 14.

Figure 5:
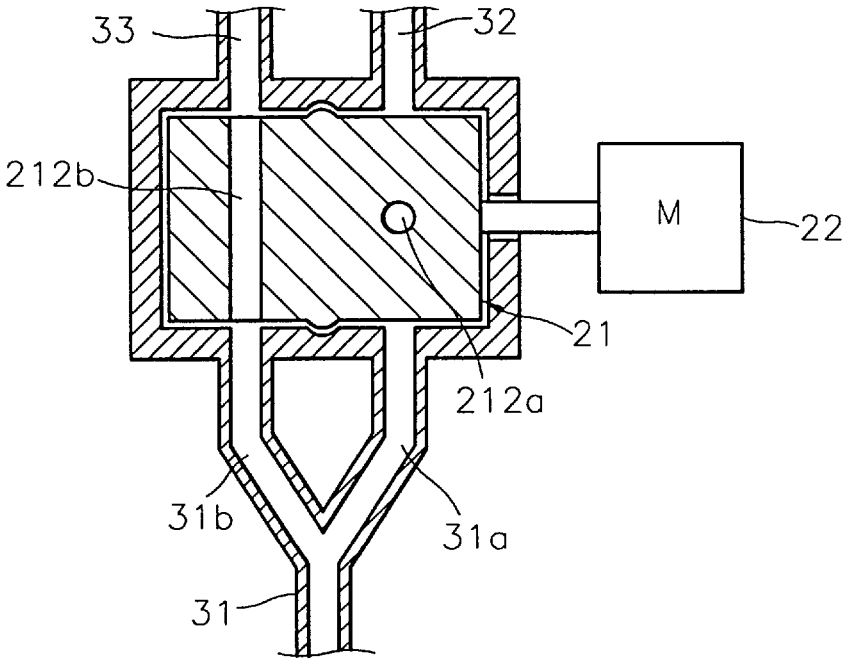

On the other hand, in a stand-by mode, i.e., when a printing operation is not performed and/or when the printer is warming up for a printing operation, the driving motor 22 is driven by a controller (not shown) to rotate the valve member 21, as shown in FIG. 5. The second branch pipe 31*b* leads to the circulation pipe 33 via the second through hole 212*b,* and the passage between the first branch pipe 31*a* and the supply pipe 32 is blocked. Here, the rotational position of the valve member 21 is maintained by the locking protrusion 21*a* fitting into the locking groove 30*a.* Thus, the pump 15 circulates the developer from the storage vessel 11, through the cabinet 30 and the circulation pipe 33. Thus, the developer discharged back into the storage vessel 11. Such a circulation thoroughly mixes the developer in the storage vessel 11, thereby preventing the toner from settling in the storage vessel 11.

Figure 6:
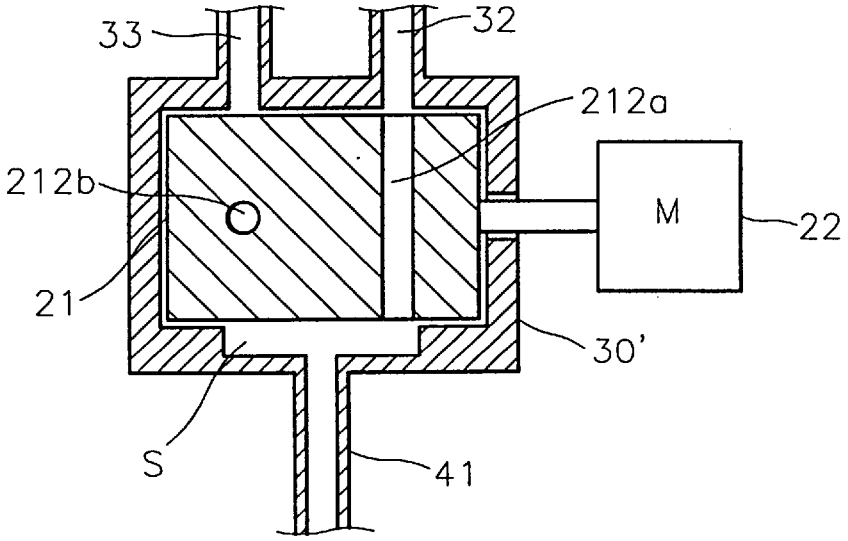
FIG. 6 is a partial cross-sectional view of an apparatus for preventing settling of toner according to another embodiment of the present invention.

FIG. 6 shows another embodiment of the present invention. An unbranched flow pipe 41 is connected to the cabinet 30. A flow space S formed inside the cabinet 30 accommodates the developer entering the cabinet 30 via the flow pipe 41. According to the rotation of the valve member 21, the flow space S communicates with either one of the through holes 212*a* or 212*b*. Thus, the developer flows though either the supply pipe 32 or circulation pipe 33. Here, the same reference numerals as those in the previous drawings denote the same members.

In another example of the flow path changing unit, a valve member having a single through hole is reciprocated by a solenoid, etc. to direct the developer in the cabinet to the supply pipe or the circulation pipe.

In the toner precipitation prevention apparatus for a developing unit according to the present invention, the developer is continuously circulated by a change in the developer flow path. As a result, the toner is advantageously prevented from being precipitated in the storage vessel.

What is claimed is:

1. An apparatus for preventing toner from settling in a wet developing unit, comprising:

a storage vessel for storing a developer;

a developing portion for applying the developer to an electrostatic latent images formed on a photosensitive medium;

a cabinet for receiving the developer from the storage vessel;

a flow pipe connected to the storage vessel and the cabinet, for leading the developer from the storage vessel to the cabinet;

a circulation pipe connected to the cabinet and the storage vessel, for returning the developer from the cabinet to the storage vessel;

a supply pipe connected to the cabinet and the developing portion, for supplying the developer from the cabinet to the developing portion; and a flow path changing, unit mounted in the cabinet for selectively directing the developer supplied via the flow pipe to one of the supply pipe and the circulation pipe.

2. The apparatus for preventing toner from settling in a wet developing unit as claimed in claim 1, wherein the flow pipe branches into a first branch pipe and second branch pipe which are connected to the cabinet.

3. The apparatus for preventing toner from settling in a wet developing unit as claimed in claim 2, wherein the flow path changing unit comprises:

a valve member mounted for rotation in the cabinet, and provided with a through hole for selectively leading one of (1) the first branch pipe to the supply pipe, and (2) the second branch pipe to the circulation pipe; and a driving source for rotating the valve member at a predetermined angle.

4. The apparatus for preventing toner from settling a wet developing unit as claimed in claim 3, further comprising a locking means for maintaining the rotational position of the valve member, when the through hole leads one of (1) the first branch pipe to the supply pipe, and (2) the second branch pipe to the circulation pipe.

5. The apparatus for preventing settling of toner for a wet developing unit as claimed in claim 4, wherein the locking means comprises:

an elastic locking protrusion formed on an outer circumference of the valve member; and a locking groove formed on an inner circumference of the cabinet into which the locking protrusion is insertable.

6. The apparatus for preventing toner from settling in a wet developing unit as claimed in claim 1, wherein a flow space is provided in the cabinet for receiving the toner entering the cabinet via the flow pipe.

7. The apparatus for preventing toner from settling in a wet developing unit as claimed in claim 6, wherein the flow path changing unit comprises:

a valve member mounted for rotation in the cabinet, and provided with a through hole for selectively leading the flow space to one of the supply pipe and the circulation pipe; and a driving source for rotating the valve member at a predetermined angle.

8. The apparatus for preventing toner from settling in a wet developing unit as claimed in claim 7, further comprising a locking means for maintaining the rotational position of the valve member, when the through hole leads the flow space to one of the supply pipe and the circulation pipe.

9. The apparatus for preventing toner from settling in a wet developing unit as claimed in claim 8, wherein the locking means comprises:

an elastic locking protrusion formed on an outer circumference of the valve member; and a locking groove formed on an inner circumference of the cabinet into which the locking protrusion is insertable.

* * * * *